US006224460B1

(12) United States Patent
Dunton et al.

(10) Patent No.: US 6,224,460 B1
(45) Date of Patent: May 1, 2001

(54) LASER INTERFEROMETRY ENDPOINT DETECTION WITH WINDOWLESS POLISHING PAD FOR CHEMICAL MECHANICAL POLISHING PROCESS

(75) Inventors: Samuel Vance Dunton, San Jose; Yizhi Xiong, Santa Clara, both of CA (US)

(73) Assignee: VLSI Technology, Inc., San Jose, CA (US)

( * ) Notice: Subject to any disclaimer, the term of this patent is extended or adjusted under 35 U.S.C. 154(b) by 0 days.

(21) Appl. No.: 09/340,487

(22) Filed: Jun. 30, 1999

(51) Int. Cl.[7] ..... B24B 49/00; B24B 51/00
(52) U.S. Cl. ..... 451/6; 451/8; 451/290
(58) Field of Search ..... 216/88, 89; 340/680; 438/692, 693; 451/5, 6, 8, 41, 63, 287, 288, 290

(56) References Cited

U.S. PATENT DOCUMENTS

| | | | | |
|---|---|---|---|---|
| 5,413,941 | | 5/1995 | Koos et al. . | |
| 5,605,760 | | 2/1997 | Roberts . | |
| 5,609,517 | | 3/1997 | Lofaro . | |
| 5,838,447 | * | 11/1998 | Hiyama et al. | 356/381 |
| 5,893,796 | * | 4/1999 | Birang et al. | 451/526 |
| 5,899,792 | * | 5/1999 | Yagi et al. | 451/6 |
| 6,014,218 | * | 1/2000 | Bradl et al. | 356/381 |
| 6,068,539 | * | 5/2000 | Bajaj et al. | 451/6 |

FOREIGN PATENT DOCUMENTS 0 663 265 11/1994 (EP) .
0738 561 A1 3/1996 (EP) .

* cited by examiner

*Primary Examiner*—Timothy V. Eley
(74) *Attorney, Agent, or Firm*—Douglas L. Weller

(57) ABSTRACT

A multi-platen chemical-mechanical polishing system is used to polish a wafer. The wafer is polished at a first station. During polishing, an endpoint is detected. The endpoint is detected by generating optical radiation by a first light source. The first optical radiation travels through a translucent area in a surface of a first platen and travels through a first polishing pad. After being reflected by the wafer, the optical radiation returns through the first polishing pad through the translucent window to a first optical radiation detector. The first polishing pad has a uniform surface in that no part of the surface of the first polishing pad includes transparent material through which non-scattered optical radiation originating from the first light source can pass and be detected by the first optical radiation detector. Optical radiation that travels through the first polishing pad and is detected by the first optical radiation detector is haze scattered by inclusions within the first polishing pad. Non-scattered light is absorbed by the first polishing pad. The wafer is also polished at a second station. During polishing a final endpoint is detected. The final endpoint is detected by generating optical radiation by a second light source. The second optical radiation travels through a translucent area in a surface of a second platen and travels through a window embedded in a second polishing pad. After being reflected by the wafer, the optical radiation returns through the window embedded in the second polishing pad, through the translucent area in the surface of the second platen, to a second optical radiation detector.

9 Claims, 3 Drawing Sheets

LASER INTERFEROMETRY ENDPOINT DETECTION WITH WINDOWLESS POLISHING PAD FOR CHEMICAL MECHANICAL POLISHING PROCESS

BACKGROUND

The present invention concerns processing of integrated circuits and pertains particularly to a laser interferometry endpoint detection with windowless polishing pad for chemical mechanical polishing process.

In a semiconductor manufacturing process, on a semiconductor wafer small electronic devices are formed of separate dies. The semiconductor wafer is processed using materials that are patterned, doped with impurities, or deposited in layers.

It is often necessary to polish a wafer surface to provide a substantially planar surface. This is done, for example, using a chemical-mechanical polishing process. Chemical-mechanical polishing is performed by pressing semiconductor wafer against a rotating polishing pad under controlled chemical, pressure, and temperature conditions. A chemical slurry, such as alumina or silica can be use as a polishing abrasive. The polishing effect on the wafer results in both a chemical and mechanical action.

In situ laser interferometry can be used to determine the end point of a chemical-mechanical polishing process. For example, an optical laser and optical radiation detector are located in a polishing platen. A transparent window is embedded into the platen surface for radiation transmission. The polishing pad has a matching embedded window made of a material that allows transmission of the laser radiation ("windowed pad"). The window embedded in the polishing pad is aligned to the window embedded on the platen so that radiation may be transmitted through the platen window and through the pad window. The aligned platen and pad windows can be referred to collectively as an "endpoint window.

As the platen rotates, the endpoint window encounters the wafer once per rotation, allowing radiation to be reflected from the wafer back through the window to the detector. During polishing of a transparent film that is coated over a substrate (e.g., silicon dioxide over silicon), as the film is removed from the surface, the intensity of the radiation at the detector has a periodicity governed by Equation 1 below:

Equation 1

$$d=\lambda/(2n\cos\theta)$$

In Equation 1, "d" is the distance through the film between peak maxima, "n" is the refractive index of the film for the radiation wavelength, "θ" is the collection angle, and "λ" is the radiation wavelength.

A plot of intensity versus polishing time will yield polishing rate and thickness removal information where the polishing rate is the time derivative of "d" in Equation 1 above.

For more information see, for example, U.S. Pat. No. 5,413,941, issued on May 9, 1995 to Daniel A. Koos and Scott Meikle for OPTICAL END POINT DETECTION METHODS IN SEMICONDUCTOR PLANARIZING POLISHING PROCESSES. See also, U.S. Pat. No. 5,609,517, issued on Mar. 11, 1997 to Michael F. Lofaro for COMPOSITE POLISHING PAD.

The Mirra™ chemical mechanical polisher system available from Applied Materials, Inc., having a business address of 2821 Scott Boulevard, Santa Clara, Calif. 95050, utilizes three independent polishing stations. This allows for two-step polishing using two platens for each wafer or three-step polishing using all three platens for each wafer. In the Mirra™ chemical mechanical polisher system, a reactor endpoint detection system is implemented such that each platen and polishing pad utilizes an endpoint window.

When a wafer is polished in a multi-platen chemical-mechanical polishing (CMP) reactor such as the Mirra™ chemical mechanical polisher system, part of the polishing is performed on one platen, and additional polishing is performed on one or more additional platens. Such sequences are used to optimize wafer throughput. The endpoint traces from platens used to polish one wafer may be "stitched" together into a virtually single trace.

CMP may be performed on wafers that simultaneously have different structures with different film thicknesses and even with different transmitting films. For example, when performing CMP for shallow trench isolation ("STI"), some parts of the reflective wafer surface are coated with silicon dioxide ("$SiO_2$") films (n=1.44) while other parts of the reflective wafer surface are coated with a multi-film structure of $SiO_2$ on top of silicon nitride ("$Si_3N_4$", n=2.00). These different structures yield different intensity versus polishing time curves that are independent of one another. However, the lateral dimensions of the structures are microscopic and the radiation collection area is several orders of magnitude larger than the structures. Therefore, a plot of radiation intensity versus polishing time is a convoluted average of the contributions of individual different structures present in the sampling area. Rotational and translational movement of the wafer during polishing result in further averaging the collected signal over a larger area of the wafer.

The embedded window in the polishing pad is made of a material that is transparent to the endpoint radiation wavelength. During manufacture, a rectangular hole is cut into the polyurethane polishing pad and the transparent window is glued into place. This configuration, however, has several disadvantages.

For example, the window material is a different surface material than the rest of the polishing pad. During data collection, when the wafer sweeps over the window in the polishing pad, the surface of the wafer is exposed to a polishing pad surface that is different from the remaining polishing pad surface. With abrasive slurry present, polishing pressure remains applied. This can result in deleterious scratching. Non-uniform polishing may also result.

Another disadvantage of using polishing pads with an embedded window is that extra manufacturing steps and materials are required to produce such polishing pads. This makes polishing pads with embedded more expensive than windowless polishing pads.

SUMMARY OF THE INVENTION

In accordance with the preferred embodiment of the present invention, a multi-platen chemical-mechanical polishing system is presented. A wafer is polished at a first station. During polishing, an endpoint is detected. The endpoint is detected by generating optical radiation by a first light source. The first optical radiation travels through a translucent area in a surface of a first platen and travels through a first polishing pad. After being reflected by the wafer, the optical radiation returns through the first polishing pad through the translucent area to a first optical radiation detector. The first polishing pad has a uniform surface in that no part of the surface of the first polishing pad includes transparent material through which non-scattered optical radiation originating from the first light source can pass and be detected by the first optical radiation detector. Optical radiation that travels through the first polishing pad and is detected by the first optical radiation detector is haze scattered by inclusions within the first polishing pad. Non-scattered light is absorbed by the first polishing pad.

The wafer is also polished at a second station. During polishing a final endpoint is detected. The final endpoint is detected by generating optical radiation by a second light source. The second optical radiation travels through a translucent area in a surface of a second platen and travels through a window embedded in a second polishing pad. After being reflected by the wafer, the optical radiation returns through the window embedded in the second polishing pad, through the translucent area in the surface of the second platen, to a second optical radiation detector.

In one preferred embodiment, for example, each light source is, an optical laser embedded in a platen. Likewise, the translucent area in a platen can consist of, for example, translucent material embedded into the surface of the platen, a hole in the surface of the platen, or an entire surface of the platen.

In the present invention, a windowless pad is used on the first polishing platen, so that the disadvantages of using windowed pads is minimized. The first half of a "stitched" endpoint trace can be collected with low signal-to-noise ratio on the first platen. Although the signal-to-noise ratio may be too low to precisely detect endpoint, when using multi-platen reactors, the actual endpoint of the process always occurs on the second platen. Therefore, a low signal-to-noise signal may be used to initiate the trace on the first platen without danger of detecting a false endpoint due to noise. Radiation source intensity may be increased to compensate for losses in the first pad, so that the average intensity of detected radiation from the first platen is close to that of the second platen. The second half of the "stitched" endpoint trace is collected from the second platen, where the second half of polishing is performed. A windowed pad is used on the second platen for optimum signal-to-noise ratio and accurate endpoint detection.

The above-described preferred embodiment of the present invention does not completely eliminate the disadvantages introduced by using a polishing pad with a window. However, the above-described preferred embodiment of the present invention does eliminate the deficiencies for at least one polishing station. This can result in the reduction of defects from scratches due to the polishing pad window material, the reduction of non-uniform polishing due to the polishing pad window material, the reduction of added cost of purchasing windowed pads, and the reduction of glazing of the platen windows due to slurry leakage.

Also, when a windowed polishing pad is used, the aqueous medium slurries used for polishing transparent films can be corrosive to the modified polishing pad. For example, in semiconductor manufacturing, inorganic dielectrics are typically polished in basic slurries. In such cases the corrosive medium may attack the glues used to hold the window in place. This can cause leaking behind the polishing pad, causing the quartz window in the platen to become glazed over time. This potential problem is alleviated by the present invention.

DESCRIPTION OF THE PRIOR ART

Figure 1:
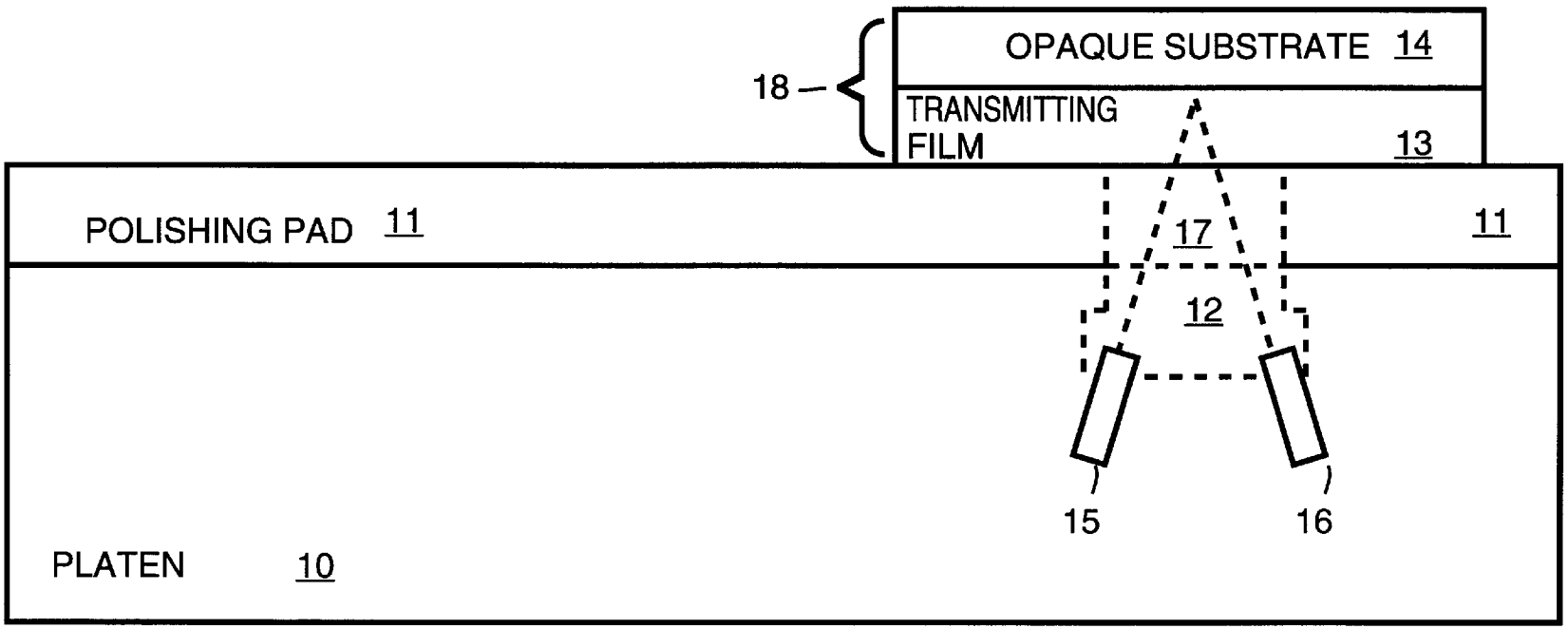
FIGURE 1 (PRIOR ART)
FIG. 1 is a simplified block diagram of a chemical mechanical polisher system that utilizes an endpoint window.

FIG. 1 is a simplified block diagram of a chemical mechanical polisher system that utilizes an endpoint window. A platen 10 includes an embedded optical laser 15 and an optical radiation detector 16. A translucent window 12 is embedded into the platen surface for radiation transmission. A polishing pad 11 has a matching embedded window 17 made of a material that allows transmission of the laser radiation. Window 17 embedded in polishing pad 11 is aligned with window 12 of platen 10 so that radiation from embedded optical laser 15 may be transmitted through platen window 12, through the pad window 17 through a transmitting film 13 of a wafer 18, reflected by a substrate 14, back through transmitting film 13, through pad window 17, through platen window 12 and detected by optical radiation detector 16. As platen 10 rotates, the endpoint window composed of window 12 and window 17, encounters wafer 18 once per rotation, allowing radiation to be reflected from wafer 18 back through the endpoint window to optical radiation detector 16.

DESCRIPTION OF THE PREFERRED EMBODIMENT

Figure 2:
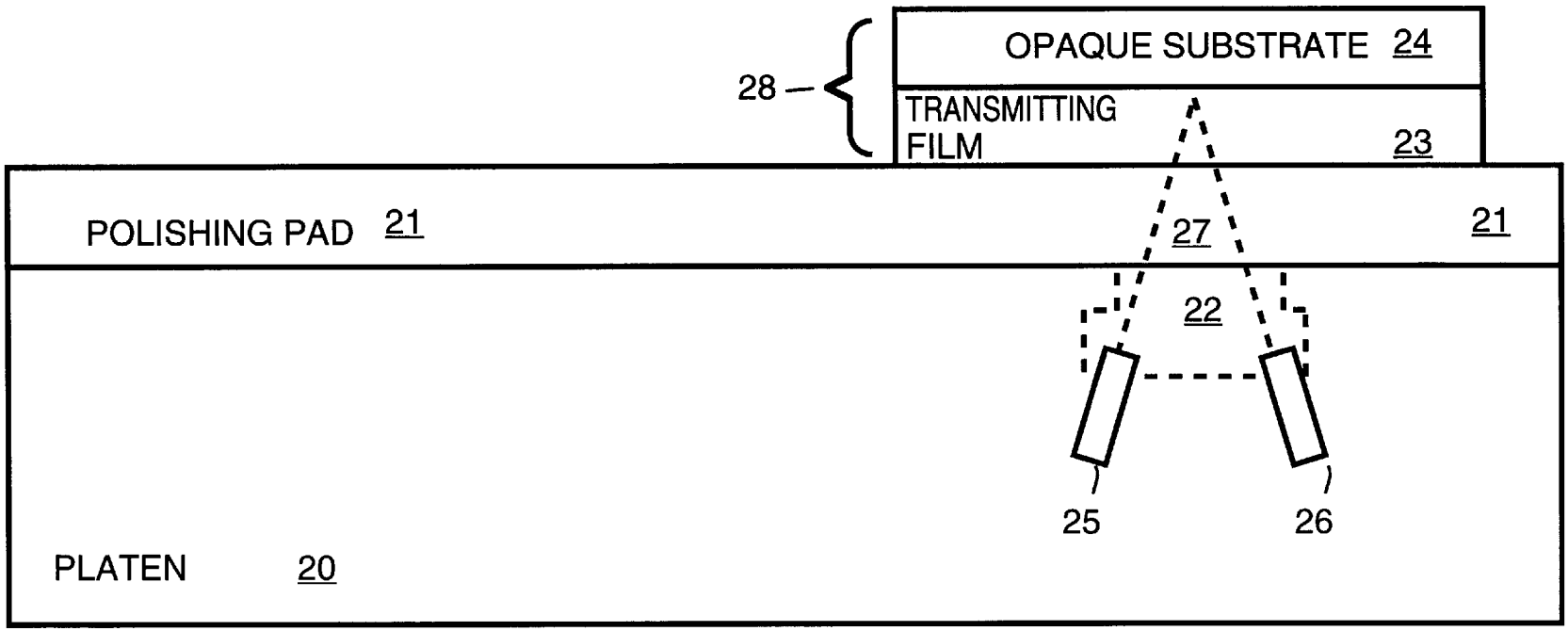
FIG. 2 is a simplified block diagram of a chemical mechanical polisher system in accordance with a preferred embodiment of the present invention.

FIG. 2 is a simplified block diagram of a chemical mechanical polisher system. In the system shown in FIG. 2, optical radiation used for laser interferometry endpoint detection can be transmitted with low signal-to-noise ratio through polishing pad 21, which does not include a translucent window. Polishing pad 21 is made of a material which has a high absorption of light. Transmission efficiency and signal-to-noise ratio are degraded because there is no translucent polymer areas (windows or nodes) that allow light to be translucently transmitted through polishing pad 21.

A platen 20 includes an embedded optical laser 25 and an optical radiation detector 26. A translucent window 22 is embedded into the platen surface for radiation transmission. Translucent window 22 can be any translucent material. Alternatively, provided platen 20 has sufficient stiffness, translucent window 22 can be merely a hole in platen 20 without any special window material. Alternatively, platen 20 can all be made from translucent material so no window is necessary.

Radiation from embedded optical laser 25 may be transmitted through platen window 22, through polishing pad 21, through a transmitting film 23 of a wafer 28, reflected by a substrate 24, back through transmitting film 23, through polishing pad 21, through platen window 22 and detected by optical radiation detector 26. As platen 20 rotates, window 22 encounters wafer 28 once per rotation, allowing radiation to be reflected from wafer 28 back through polishing pad 21 and window 22 to optical radiation detector 26.

While in the preferred embodiment, an optical laser is used to provide optical radiation, any other light source may be used that is capable of generating sufficient optical radiation to be detected by optical radiation detector 26 after passing through polishing pad 21. The light source may be embedded within platen 20 or may be located below platen 20.

Polishing pad 21 is composed of materials that absorb light. That is, the pad materials use to manufacture polishing pad 21 have chemical bonds and atomic electrons absorb visible light. If the pad materials were solid, the thicknesses used are sufficient to prevent light transmission with the laser light intensity generated by embedded optical laser 25. However, the pad materials typically have inclusions to give desirable mechanical properties. The inclusions scatter visible light. Some of the scattered light is transmitted through polishing pad 21, reflected by reflected by a substrate 24, and transmitted back through the pad to optical radiation detector 26. Such scattered light is available for signal processing at reduced signal-to-noise-ratio as compared to using a pad with a transparent window.

The scattered light that is transmitted through polishing pad 21 is referred to as haze. "Haze" is the cloudy appearance in a plastic material caused by inclusions that produce light scattering. Haze may be defined as the percentage of transmitted light that is scattered more than 2.5° from the incident beam.

Polishing pad 21 is composed of, for example, polyurethane or some other material or combination of materials with a high absorption of light. In the preferred embodiment, to form polishing pad 21, polyurethane is laminated onto a base layer of a different polymer material, such as SubaIV material available from Rodel having a business address at 34j06 East Wadkins Street, Phoenix, Ariz. 85034. The polyurethane and polymer material are engineered to give desired mechanical properties (e.g., porosity, compressibility) for CMP. As a result, polishing pad 21 has a high absorbency for visible light, including the 633-nm red helium-neon laser light detected by optical radiation detector 26. However, because of the above described inclusions in the polyurethane, the luminous transmittance of polishing pad 21 is not zero.

Thus the light that travels through polishing pad 21 and is detected by optical radiation detector 26 is haze, i.e., light that is scattered by inclusions within polishing pad 21. Non-scattered light is absorbed by the polyurethane and polymer material of which polishing pad 21 is composed.

In one embodiment of the present invention, a multi-platen polishing system is used. Radiation is collected during the initial polishing with low signal-to-noise ratio using a "windowless" polishing pad on a first polishing platen. The polishing is completed, with high signal-to-noise ratio desirable for accurate endpoint determination, using a polishing pad, having a window, placed on a second platen.

Figure 3:
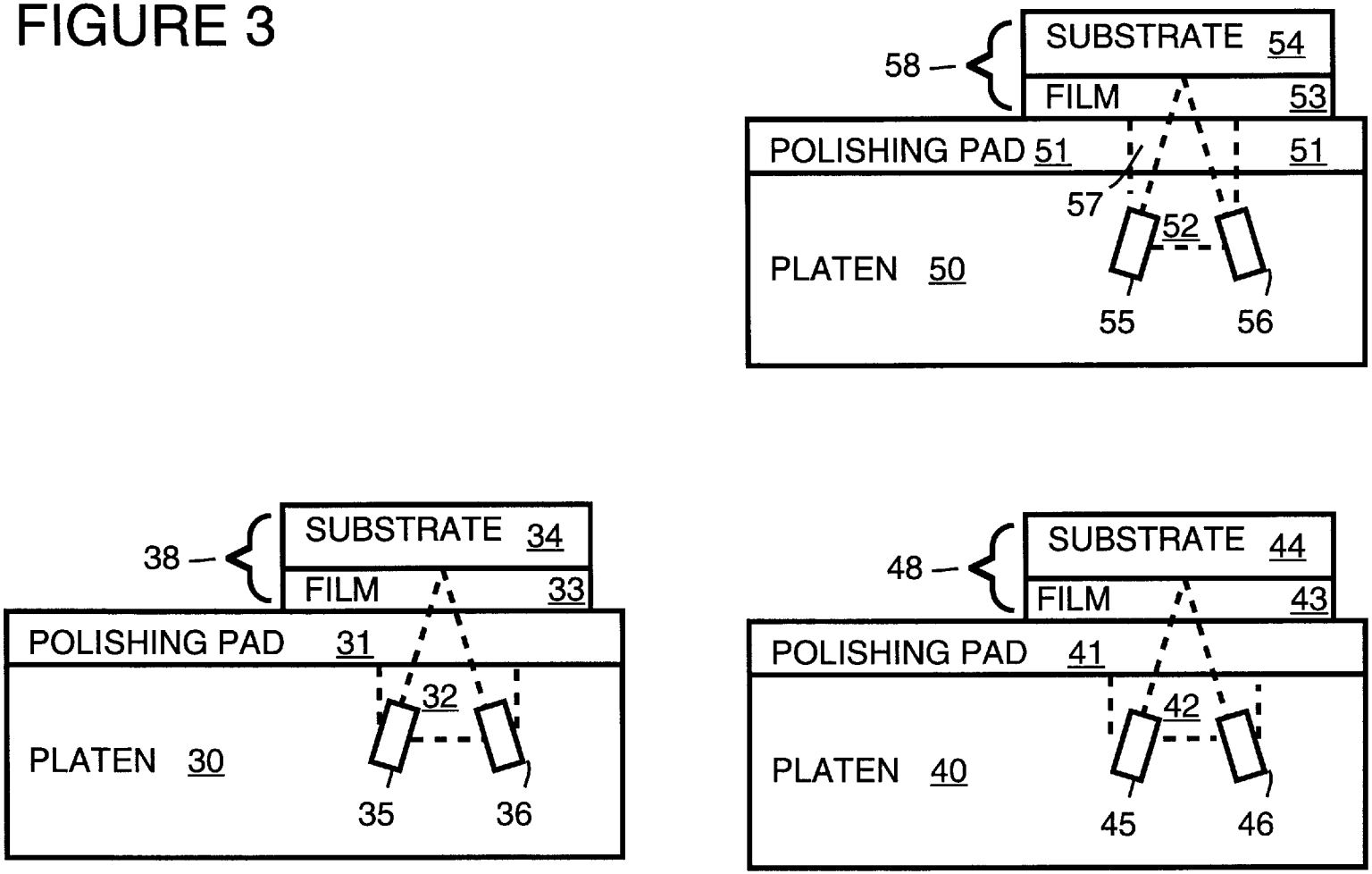
FIG. 3 is a simplified block diagram of a multi-platen chemical mechanical polisher system in accordance with a preferred embodiment of the present invention.

For example, FIG. 3 shows a first station utilizing a platen 30. Platen 30 includes an embedded optical laser 35 and an optical radiation detector 36. A translucent window 32 is embedded into the platen surface for radiation transmission. Radiation from embedded optical laser 35 may be transmitted through platen window 32, through polishing pad 31, through a transmitting film 33 of a wafer 38, reflected by a substrate 34, back through transmitting film 33, through polishing pad 31, through platen window 32 and detected by optical radiation detector 36. As platen 30 rotates, window 32 encounters wafer 38 once per rotation, allowing radiation to be reflected from wafer 38 back through polishing pad 31 and window 32 to optical radiation detector 36. The light that travels through polishing pad 21 and is detected by optical radiation detector 36 is haze, i.e., light that is scattered by inclusions within polishing pad 31. Non-scattered light is absorbed by the polyurethane and polymer material of which polishing pad 31 is composed.

A second station utilizes a platen 40. Platen 40 includes an embedded optical laser 45 and an optical radiation detector 46. A translucent window 42 is embedded into the platen surface for radiation transmission. Radiation from embedded optical laser 45 may be transmitted through platen window 42, through polishing pad 41, through a transmitting film 43 of a wafer 48, reflected by a substrate 44, back through transmitting film 43, through polishing pad 41, through platen window 42 and detected by optical radiation detector 46. As platen 40 rotates, window 42 encounters wafer 48 once per rotation, allowing radiation to be reflected from wafer 48 back through polishing pad 41 and window 42 to optical radiation detector 46.

A third station utilizes a platen 50. Platen 50 includes an embedded optical laser 55 and an optical radiation detector 56. A translucent window 52 is embedded into the platen surface for radiation transmission. A polishing pad 51 has a matching embedded window 57 made of a material that allows transmission of the laser radiation. Window 57 embedded in polishing pad 51 is aligned with window 52 of platen 50 so that radiation from embedded optical laser 55 may be transmitted through platen window 52, through the pad window 57 through a transmitting film 53 of a wafer 58, reflected by a substrate 54, back through transmitting film 53, through pad window 57, through platen window 52 and detected by optical radiation detector 56. As platen 50 rotates, the endpoint window composed of window 52 and window 57, encounters wafer 58 once per rotation, allowing radiation to be reflected from wafer 58 back through the endpoint window to optical radiation detector 56.

A plot of intensity versus polishing time, as discussed above, yields polishing rate and thickness removal information. When monitoring polishing rate of a single wafer polished using two platens, the first half of a "stitched" endpoint trace is collected with low signal-to-noise ratio on the first platen using a windowless polishing pad. Although the signal-to-noise ratio may be too low to precisely detect an endpoint, this is not necessary since there is still another polishing step. The final polishing step is performed using a platen with a polishing pad that has an embedded window.

Likewise, when monitoring polishing rate of a single wafer polished using three platens, the two parts of a "stitched" endpoint trace is collected with low signal-to-noise ratio on a first platen and a second platen which each have a windowless polishing pad. The low signal-to-noise ratio allow for enough precision in endpoint detection because there is still another polishing step. The final polishing step is performed using a platen with a polishing pad that has an embedded window.

In an alternative embodiment of the present invention, a wafer is polished in a multi-platen polishing system where none of the polishing pads used to polish the wafer have translucent windows. Radiation is collected during the initial polishing with low signal-to-noise ratio using a "windowless" polishing pad on a first polishing platen. The polishing is completed, with low signal-to-noise ratio using a "windowless" polishing pad on a second platen or a third platen. The low signal-to-noise ratio is overcome by using more efficient signal filtering techniques.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A multi-platen chemical-mechanical polishing system comprising:

a first station, including:
- a first platen,
- a first light source,
- a first optical radiation detector,
- a first translucent area in a surface of the first platen, and a first polishing pad, the first polishing pad including translucent material through which passes non-scattered optical radiation originating from the first light source and detected by the first optical radiation detector; and, a second station, including:

a second platen, a second light source, a second optical radiation detector, a second translucent area in a surface of the second platen, and a second polishing pad, the second polishing pad not including translucent material through which non-scattered optical radiation originating from the second light source can pass and be detected by the second optical radiation detector, wherein optical radiation that travels through the second polishing pad and is detected by the second optical radiation detector is haze scattered by inclusions within the second polishing pad, non-scattered light being absorbed by the second polishing pad.

2. A multi-platen chemical-mechanical polishing system as in claim 1, wherein the second polishing pad comprises polyurethane.

3. A multi-platen chemical-mechanical polishing system as in claim 1, additionally comprising:

a third station, including:

a third platen, a third light source, a third optical radiation detector, a third translucent area in a surface of the third platen, and a third polishing pad, the third polishing pad not including translucent material through which non-scattered optical radiation originating from the third light source can pass and be detected by the third optical radiation detector, wherein optical radiation that travels through the third polishing pad and is detected by the third optical radiation detector is haze scattered by inclusions within the third polishing pad, non-scattered light being absorbed by the third polishing pad.

4. A multi-platen chemical-mechanical polishing system as in claim 1 wherein the second light source is an optical laser embedded in the second platen.

5. A multi-platen chemical-mechanical polishing system as in claim 1 wherein the second translucent area comprises translucent material embedded into the surface of the second platen.

6. A multi-platen chemical-mechanical polishing system as in claim 1 wherein the second translucent area comprises a hole in the surface of the second platen.

7. A multi-platen chemical-mechanical polishing system as in claim 1 wherein the second translucent area includes an entire surface of the second platen.

8. A multi-platen chemical-mechanical polishing system comprising:

a first station, including:

a first platen, a first light source, a first optical radiation detector, a first translucent area in a surface of the first platen, and a first polishing pad, the first polishing pad having a uniform surface in that no part of the surface of the first polishing pad includes transparent material through which non-scattered optical radiation originating from the first light source can pass and be detected by the first optical radiation detector, wherein, in order to detect a first endpoint during polishing of a workpiece, optical radiation originating from the first light source travels through the first translucent area in the surface of the first platen, through the first polishing pad and after being reflected by the workpiece returns through the first polishing pad through the first translucent area to the first optical radiation detector, and wherein optical radiation that travels through the first polishing pad and is detected by the first optical radiation detector is haze scattered by inclusions within the first polishing pad, non-scattered light being absorbed by the first polishing pad; and, a second station, including:

a second platen, a second light source, a second optical radiation detector, a second translucent area in a surface of the second platen, and a second polishing pad, the second polishing pad having a uniform surface, in that no part of the surface of the second polishing pad includes transparent material through which non-scattered optical radiation originating from the second light source can pass and be detected by the second optical radiation detector, wherein, in order to detect a second endpoint during polishing a workpiece in contact with the second polishing pad, optical radiation originating from the second light source travels through the second translucent area in the surface of the second platen, through the second polishing pad and after being reflected by the workpiece in contact with the second polishing pad returns through the second polishing pad through the second translucent area to the second optical radiation detector, and wherein optical radiation that travels through the second polishing pad and is detected by the second optical radiation detector is haze scattered by inclusions within the second polishing pad, non-scattered light being absorbed by the second polishing pad.

9. A multi-platen chemical-mechanical polishing system as in claim 8, wherein the first polishing pad and the second polishing pad comprises polyurethane.

* * * * *